US011111553B2

(12) United States Patent
Kimata et al.

(10) Patent No.: US 11,111,553 B2
(45) Date of Patent: Sep. 7, 2021

(54) HIGH-STRENGTH STEEL SHEET AND METHOD FOR PRODUCING THE SAME

(71) Applicant: JFE STEEL CORPORATION, Tokyo (JP)

(72) Inventors: Yusuke Kimata, Tokyo (JP); Yoshihiko Ono, Tokyo (JP); Kenji Kawamura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 389 days.

(21) Appl. No.: 16/076,381

(22) PCT Filed: Feb. 7, 2017

(86) PCT No.: PCT/JP2017/004311
§ 371 (c)(1),
(2) Date: Aug. 8, 2018

(87) PCT Pub. No.: WO2017/138504
PCT Pub. Date: Aug. 17, 2017

(65) Prior Publication Data

US 2019/0040483 A1 Feb. 7, 2019

(30) Foreign Application Priority Data

Feb. 10, 2016 (JP) ..... JP2016-023374
Dec. 5, 2016 (JP) ..... JP2016-235853

(51) Int. Cl.
*C21D 8/02* (2006.01)
*C21D 9/46* (2006.01)
(Continued)

(52) U.S. Cl.
CPC ..... *C21D 8/0247* (2013.01); *C21D 6/002* (2013.01); *C21D 6/005* (2013.01); *C21D 8/0205* (2013.01);
(Continued)

(58) Field of Classification Search
CPC .... C21D 8/0247; C21D 6/002; C21D 8/0205; C21D 6/005; C21D 8/0226; C21D 8/0236;
(Continued)

(56) References Cited

U.S. PATENT DOCUMENTS

2011/0162762 A1* 7/2011 Matsuda ..... C22C 38/06 148/533
2013/0087253 A1 4/2013 Matsuda et al.
(Continued)

FOREIGN PATENT DOCUMENTS

EP 2 546 382 A1 1/2013
EP 2759615 A1 7/2014
(Continued)

OTHER PUBLICATIONS

Oct. 9, 2018 Search Report issued in European Patent Application No. 17750227.5.
(Continued)

*Primary Examiner* — John A Hevey
(74) *Attorney, Agent, or Firm* — Oliff PLC

(57) ABSTRACT

A high-strength steel sheet having a tensile strength (TS) of 1,320 MPa or more and good workability. The high-strength steel sheet has a specific component composition and a steel microstructure containing, on an area-percentage basis with respect to the entire steel microstructure, 40% or more and less than 85% of a lower bainite, 5% or more and less than 40% martensite including tempered martensite, 10% or more and 30% or less retained austenite, and 10% or less (including 0%) polygonal ferrite, the retained austenite having an average C content of 0.60% by mass or more. Additionally, a Mn segregation value at a surface of the steel sheet is 0.8% or less, the ratio R/t of a limit bending radius (R) to a thickness (t) of the steel sheet is 2.0 or less, and
(Continued)

tensile strength×total elongation of the steel sheet is 15,000 MPa % or more.

8 Claims, 2 Drawing Sheets

(51) Int. Cl.

| | |
|---|---|
| ***C22C 38/06*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |
| ***C21D 6/00*** | (2006.01) |
| ***C22C 38/54*** | (2006.01) |

(52) U.S. Cl.
CPC ..... *C21D 8/0226* (2013.01); *C21D 8/0236* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 9/46; C21D 2211/005; C21D 2211/001; C21D 2211/002; C21D 2211/008; C21D 1/19; C21D 1/25; C22C 38/58; C22C 38/005; C22C 38/54; C22C 38/001; C22C 38/002; C22C 38/02; C22C 38/04; C22C 38/42; C22C 38/44; C22C 38/46; C22C 38/48; C22C 38/50; C22C 38/06
See application file for complete search history.

(56) References Cited

U.S. PATENT DOCUMENTS

| | | | | |
|---|---|---|---|---|
| 2014/0342183 | A1* | 11/2014 | Wakabayashi ..... | C21D 8/0426 428/659 |
| 2015/0017471 | A1* | 1/2015 | Shuto ..... | B32B 15/01 428/659 |
| 2015/0376730 | A1* | 12/2015 | Shuto ..... | C22C 38/005 428/659 |
| 2018/0237881 | A1* | 8/2018 | Okamoto ..... | C22C 38/14 |

FOREIGN PATENT DOCUMENTS

| | | | |
|---|---|---|---|
| EP | 2 910 662 | A1 | 8/2015 |
| JP | H04-235253 | A | 8/1992 |
| JP | H11-256273 | A | 9/1999 |
| JP | 2004-76114 | A | 3/2004 |
| JP | 2009-263685 | A | 11/2009 |
| JP | 2013-72101 | A | 4/2013 |
| JP | 2015-151576 | A | 8/2015 |
| JP | 2015-224359 | A | 12/2015 |
| KR | 20120074798 | A | 7/2012 |
| KR | 20140072180 | A | 6/2014 |
| WO | 2011/111330 | A1 | 9/2011 |
| WO | 2014/061270 | A1 | 4/2014 |

OTHER PUBLICATIONS

Mar. 23, 2020 Notice of Allowance issued in Korean Patent Application No. 10-2018-7022649.
Sep. 24, 2019 Office Action issued in Chinese Patent Application No. 201780010611.6.
Aug. 29, 2019 Office Action issued in Korean Patent Application No. 10-2018-7022649.
May 16, 2017 International Search Report issued in International Patent Application No. PCT/JP2017/004311.

* cited by examiner

HIGH-STRENGTH STEEL SHEET AND METHOD FOR PRODUCING THE SAME

TECHNICAL FIELD

The present disclosure relates to a high-strength steel sheet and a method for producing the high-strength steel sheet.

BACKGROUND ART

In recent years, an improvement in the fuel efficiency of automobiles has been an important issue in view of global environmental conservation. Active attempts have thus been made to reduce the weight of automobile bodies by increasing the strength of automobile materials and thus reducing the thicknesses of automobile components.

To increase the strength of a steel sheet, the percentages of hard phases such as martensite and bainite in the entire steel microstructure generally need to be increased. Unfortunately, the increase in the strength of the steel sheet by increasing the percentages of the hard phases degrades workability. Thus, the development of a steel sheet having both high strength and good workability is desired. Hitherto, various composite-microstructure steel sheets, such as ferrite-martensite dual phase steel (DP steel) and TRIP steel utilizing transformation-induced plasticity of retained austenite, have been developed.

In the case where the percentages of the hard phases are increased in a composite-microstructure steel sheet, the workability of the steel sheet is strongly affected by the workability of the hard phases. The reason for this is as follows: In the case where the percentages of the hard phases are low and where the percentage of soft polygonal ferrite is high, the deformation ability of the polygonal ferrite dominates the workability of the steel sheet. That is, even in the case of insufficient workability of the hard phases, the workability such as ductility is ensured. In contrast, in the case where the percentages of the hard phases are high, the workability of the steel sheet is directly affected not by the deformation ability of polygonal ferrite but by deformation abilities of the hard phases themselves.

Thus, in the case of a cold-rolled steel sheet, the workability of martensite is improved as follows: Heat treatment for adjusting the content of polygonal ferrite formed in the annealing process and the subsequent cooling process is performed. The resulting steel sheet is subjected to water quenching to form martensite. The steel sheet is heated and maintained at a high temperature to temper martensite, thereby forming a carbide in martensite, which is a hard phase, to improve the workability of martensite. Usually, in the case of a continuous annealing and quenching apparatus with the function to perform such water quenching, however, because the temperature after quenching is naturally a temperature in the vicinity of the temperature of water and because most of untransformed austenite undergoes martensitic transformation, a difficulty lies in using retained austenite and other low-temperature transformation microstructures. Thus, the workability of the hard phases is improved by only the effect of the tempering of martensite, leading to a limited improvement in the workability of a steel sheet.

Regarding a composite-microstructure steel sheet containing retained austenite, for example, Patent Literature 1 discloses a high-strength steel sheet having good bending workability and impact characteristics, containing specified alloy components, and having a steel microstructure composed of fine, uniform bainite containing retained austenite.

Patent Literature 2 discloses a composite-microstructure steel sheet having good bake hardenability, containing specified alloy components, and having a steel microstructure composed of bainite containing retained austenite, the bainite having a specified retained austenite content.

Patent Literature 3 discloses a composite-microstructure steel sheet having good impact resistance, containing specified alloy components, and having a steel microstructure containing, on an area percentage basis, 90% or more retained austenite-containing bainite that has a retained austenite content of 1% or more and 15% or less and specified hardness (HV).

CITATION LIST

Patent Literature

PTL 1: Japanese Unexamined Patent Application Publication No. 04-235253

PTL 2: Japanese Unexamined Patent Application Publication No. 2004-76114

PTL 3: Japanese Unexamined Patent Application Publication No. 11-256273

SUMMARY

Technical Problem

However, the foregoing steel sheets have problems described below. In the case of the component composition described in Patent Literature 1, when strain is applied to the steel sheet, a difficulty lies in ensuring the content of stable retained austenite that provides the TRIP effect in a high-strain region. Thus, although bendability is provided, the ductility is low until plastic instability occurs, and the punch stretchability is poor.

Although the steel sheet described in Patent Literature 2 has good bake hardenability, the microstructure mainly contains bainite or mainly contains bainite and ferrite and minimizes martensite; thus, it is difficult to provide a tensile strength (TS) of more than 1,180 MPa and ensure good workability when the strength is increased.

The steel sheet described in Patent Literature 3 is mainly aimed at having improved impact resistance and contains, as a main phase, bainite having a hardness, HV, of 250 or less, specifically has a microstructure containing 85% or more of the bainite. Thus, a major difficulty lies in imparting a tensile strength (TS) of more than 1,180 MPa to the steel sheet described in Patent Literature 3.

Among automobile components formed by press forming, for example, steel sheets used as materials for components such as door impact beams and bumper reinforcements that suppress deformation at the time of automotive crashes are seemingly required to have a tensile strength (TS) of 1,180 MPa or more and, in the future, 1,320 MPa or more.

The present disclosure advantageously solves the problem that a difficulty lies in ensuring good workability because of its high strength. The present disclosure aims to provide a high-strength steel sheet having a tensile strength (TS) of 1,320 MPa or more and good workability, in particular, good bending workability, and an advantageous production method therefor.

Solution to Problem

To solve the foregoing problems, the inventors have conducted intensive studies on component compositions and steel microstructures of steel sheets and have found that a high-strength steel sheet having good workability, in particular, an excellent balance among strength, ductility, and bendability and a tensile strength of 1,320 MPa or more is produced by increasing the strength using martensite and a lower bainite microstructure, increasing the C content of a steel sheet, rapidly cooling the steel sheet annealed in an single-phase austenite region to partially transform austenite into martensite, and stabilizing tempered martensite, lower-bainite transformation, and retained austenite. The disclosed exemplary embodiments are described below.

[1] A high-strength steel sheet includes a component composition containing, on a percent by mass basis, C: 0.15% to 0.40%, Si: 0.5% to 2.5%, Mn: 0.5% to 2.4%, P: 0.1% or lower, S: 0.01% or lower, Al: 0.01% to 0.5%, and N: 0.010% or lower, the balance being substantially Fe and incidental impurities, and a steel microstructure containing, on an area-percentage basis with respect to the entire steel microstructure, 40% or more and less than 85% of a lower bainite, 5% or more and less than 40% martensite including tempered martensite, 10% or more and 30% or less retained austenite, and 10% or less (including 0%) polygonal ferrite, the retained austenite having an average C content of 0.60% by mass or more, in which a Mn segregation value at a surface (a difference between maximum and minimum values of a Mn concentration) is 0.8% or less, the tensile strength is 1,320 MPa or more, the ratio R/t of a limit bending radius (R) to a thickness (t) is 2.0 or less, tensile strength×total elongation is 15,000 MPa·% or more, and tensile strength×hole expansion ratio is 50,000 MPa·% or more.

[2] In the high-strength steel sheet described in [1], the component composition further contains, on a percent by mass basis, one or two or more selected from Cr: 0.005% to 1.0%, V: 0.005% to 1.0%, Ni: 0.005% to 1.0%, Mo: 0.005% to 1.0%, and Cu: 0.01% to 2.0%.

[3] In the high-strength steel sheet described in [1] or [2], the component composition further contains, on a percent by mass basis, one or two selected from Ti: 0.005% to 0.1%, and Nb: 0.005% to 0.1%.

[4] In the high-strength steel sheet described in any one of [1] to [3], the component composition further contains, on a percent by mass basis, B: 0.0003% to 0.0050%.

[5] In the high-strength steel sheet described in any one of [1] to [4], the component composition further contains, on a percent by mass basis, one or two selected from Ca: 0.001% to 0.005% and REM: 0.001% to 0.005%.

[6] A method for-producing a high-strength steel sheet includes subjecting a steel slab having the component composition described in any one of [1] to [5] to hot rolling at a reduction ratio of a first pass in rough rolling of 10% or more and then cold rolling to form a cold-rolled steel sheet, annealing the cold-rolled steel sheet in a single-phase austenite region for 200 seconds or more and 1,000 seconds or less, cooling the steel sheet from an annealing temperature to $Ac_3$—100° C. at an average cooling rate of 5° C./s or more, cooling the steel sheet from $Ac_3$-100° C. to a first temperature range of a martensitic transformation start temperature (Ms)—100° C. or higher and lower than Ms at an average cooling rate of 20° C./s or more, after the cooling, increasing the temperature of the steel sheet to a second temperature range of 300° C. or higher, a bainitic transformation start temperature (Bs)—150° C. or lower, and 450° C. or lower, and after the temperature increase, retaining the steel sheet in the second temperature range for 15 seconds or more and 1,000 seconds or less.

Advantageous Effects

According to the present disclosure, the high-strength steel sheet having good workability, in particular, an excellent balance among strength, ductility, and bendability and having a tensile strength of 1,320 MPa or more is provided.

DESCRIPTION OF EMBODIMENTS

Figure 1:
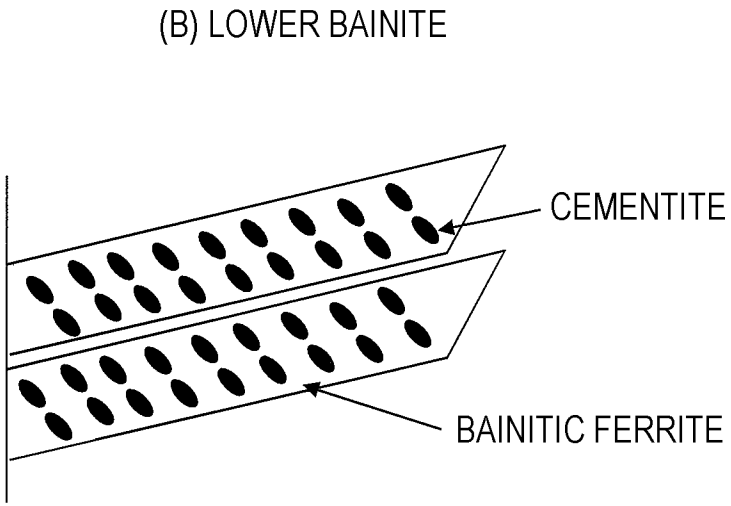
FIG. 1 is an explanatory drawing of an upper bainite and a lower bainite.
Figure 1:
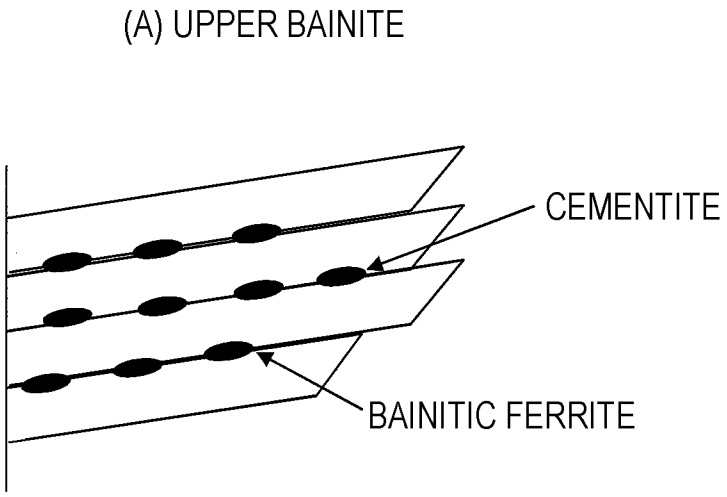

Exemplary embodiments of the present disclosure will be described below. The present disclosure is not limited to these embodiments.

<High-Strength Steel Sheet>

A high-strength steel sheet of the present disclosure has a component composition, a steel microstructure, a surface state, and characteristics described below.

Explanations will be given in the following order: the component composition, the steel microstructure, and the characteristics.

(Component Composition) The component composition contains, on a percent by mass basis, C: 0.15% to 0.40%, Si: 0.5% to 2.5%, Mn: 0.5% to 2.4%, P: 0.1% or less, S: 0.01% or less, Al: 0.01% to 0.5%, and N: 0.010% or less, the balance being substantially Fe and incidental impurities.

(Steel Microstructure) The steel microstructure contains, on an area-percentage basis with respect to the entire steel microstructure, 40% or more and less than 85% of a lower bainite, 5% or more and less than 40% martensite including tempered martensite, 10% or more and 30% or less retained austenite, and 10% or less (including 0%) polygonal ferrite, the retained austenite having an average C content of 0.60% by mass or more.

(Surface State) A Mn segregation value at a surface (a difference between maximum and minimum values of a Mn concentration) is 0.8% or less.

(Characteristics) The tensile strength is 1,320 MPa or more. The ratio R/t of a limit bending radius (R) to a thickness (t) (hereinafter, referred to as a "limit bending index") is 2.0 or less. Tensile strength×total elongation is 15,000 MPa·% or more. Tensile strength×hole expansion ratio is 50,000 MPa·% or more.

The high-strength steel sheet of the present disclosure has a component composition containing, on a percent by mass basis, C: 0.15% to 0.40%, Si: 0.5% to 2.5%, Mn: 0.5% to 2.4%, P: 0.1% or less, S: 0.01% or less, Al: 0.01% to 0.5%, and N: 0.010% or less, the balance being substantially Fe and incidental impurities.

The component composition may further contain, on a percent by mass basis, one or two or more selected from Cr: 0.005% to 1.0%, V: 0.005% to 1.0%, Ni: 0.005% to 1.0%, Mo: 0.005% to 1.0%, and Cu: 0.01% to 2.0%.

The component composition may further contain, on a percent by mass basis, one or two selected from Ti: 0.005% to 0.1% and Nb: 0.005% to 0.1%.

The component composition may further contain, on a percent by mass basis, B: 0.0003% to 0.0050%.

The component composition may further contain, on a percent by mass basis, one or two selected from Ca: 0.001% to 0.005% and REM: 0.001% to 0.005%.

These components will be described below. In the following description, the symbol "%" that expresses the content of a component refers to "% by mass".

C: 0.15% or more and 0.40% or less

C is an essential element to increase the strength of the steel sheet and to ensure the stable content of retained austenite. C is also an element required for a sufficient martensite content and for retaining austenite at room temperature. A C content of less than 0.15% makes it difficult to ensure good strength and workability of the steel sheet. A C content of more than 0.40% causes a significant hardening of a weld and a heat-affected zone, thus leading to degraded weldability. Accordingly, the C content is 0.15% or more and 0.40% or less, preferably 0.25% or more and 0.40% or less, more preferably 0.30% or more and 0.40% or less.

Si: 0.5% or more and 2.5% or less

Si is a useful element that contributes to an improvement in the strength of steel owing to solid-solution hardening and the inhibition of carbide. To provide the effects, the Si content is 0.5% or more. However, a Si content of more than 2.5% can cause the degradation of surface properties and chemical conversion treatability due to the formation of red scale or the like; thus, the Si content is 2.5% or less.

Mn: 0.5% or more and 2.4% or less

Mn is an important element effective in strengthening steel and stabilizing austenite in the present disclosure. To provide the effects, the Mn content is 0.5% or more. However, a Mn content of more than 2.4% results in the inhibition of bainitic transformation and the formation of segregates acting as starting points of cracks due to bending, thereby degrading the workability. Accordingly, the Mn content needs to be 2.4% or less, and is preferably 1.0% or more and 2.0% or less. The Mn segregation can be reduced at a Si/Mn ratio of 0.5 or more, preferably 0.6 or more.

P: 0.1% or less

P is an element useful in strengthening steel. However, at a P content of more than 0.1%, embrittlement is caused by grain boundary segregation to decrease the impact resistance. Furthermore, when the steel sheet is subjected to hot-dip galvannealing, the alloying rate is significantly decreased. Accordingly, the P content is 0.1% or less, preferably 0.05% or less. The P content is preferably reduced; however, achieving a P content of less than 0.005% requires a significant increase in cost. Thus, the lower limit thereof is preferably about 0.005%.

S: 0.01% or less

S is present in the form of inclusions such as MnS and causes a decrease in impact resistance and cracking along a metal flow in a weld; thus, the S content is preferably minimized as much as possible. However, an excessive reduction in S content leads to an increase in production cost. Thus, the S content is 0.01% or less, preferably 0.005% or less, more preferably 0.001% or less. Achieving a S content of less than 0.0005% requires a marked increase in production cost. Thus, the lower limit thereof is about 0.0005% in view of the production cost.

Al: 0.01% or more and 0.5% or less

Al is a useful element added as a deoxidizer in a steel making process. To provide the effect, an Al content of 0.01% or more is required. An Al content of more than 0.5% results in an increase in the risk of slab cracking during continuous casting. Accordingly, the Al content is 0.01% or more and 0.5% or less.

N: 0.010% or less

N is an element that most degrades the aging resistance of steel; thus, the N content is preferably minimized as much as possible. A N content of more than 0.010% results in a significant decrease in aging resistance. Thus, the N content is 0.010% or less. Achieving a N content of less than 0.001% requires a marked increase in production cost. Thus, the lower limit thereof is about 0.001% in view of the production cost.

In the present disclosure, the following components may be appropriately contained in addition to the foregoing components.

One or Two or more Selected from Cr, V, Ni, and Mo: 0.005% or more and 1.0% or less, and Cu: 0.01% or more and 2.0% or less Cr, V, Ni, Mo, and Cu are elements having the effect of inhibiting the formation of pearlite during cooling from an annealing temperature. The effect is provided when the Cr content, the V content, the Ni content, or the Mo content is 0.005% or more or when the Cu content is 0.01% or more. When the Cr content, the V content, the Ni content, or the Mo content is more than 1.0% or when the Cu content is more than 2.0%, the hard martensite content is excessively large, thus failing to provide necessary workability. Accordingly, when Cr, V, Ni, Mo, and Cu are contained, the steel sheet contains Cr: 0.005% or more and 1.0% or less, V: 0.005% or more and 1.0% or less, Ni: 0.005% or more and 1.0% or less, Mo: 0.005% or more and 1.0% or less, and Cu: 0.01% or more and 2.0% or less.

One or Two Selected from Ti: 0.005% or more and 0.1% or less and Nb: 0.005% or more and 0.1% or less Ti and Nb are useful for the precipitation strengthening of steel. The effect is provided when the Ti content or the Nb content is 0.005% or more. When the Ti content or the Nb content is more than 0.1%, the workability and the shape fixability are degraded. Thus, when Ti and Nb are contained, the steel sheet contains Ti: 0.005% or more and 0.1% or less and Nb: 0.005% or more and 0.1% or less.

B: 0.0003% or more and 0.0050% or less

B is an element useful for inhibiting the formation and growth of polygonal ferrite from austenite grain boundaries. The effect is provided when the B content is 0.0003% or more. A B content of more than 0.0050% results in the degradation of workability. Thus, when B is contained, the steel sheet contains B: 0.0003% or more and 0.0050% or less.

One or Two Selected from Ca: 0.001% or more and 0.005% or less and REM: 0.001% or more and 0.005% or less Ca and REM are each an element effective in improving workability by controlling the form of sulfides. To provide the effect, the content of at least one element selected from Ca and REM needs to be 0.001% or more. If the content of Ca or REM is more than 0.005%, the cleanliness of steel is adversely affected. Accordingly, each of the Ca content and the REM content is 0.001% to 0.005%.

In the steel sheet of the present disclosure, components other than the foregoing components are Fe and incidental impurities. However, any component other than the components may be contained as long as the effects of the present disclosure are not impaired. In particular, even if the content of the foregoing optional component is less than the lower limit, the effects of the present disclosure are not impaired. Thus, when the content of the optional element is less than the lower limit, the element is regarded as an incidental impurity.

The steel microstructure will be described below. The steel microstructure of the high-strength steel sheet of the present disclosure contains, on an area-percentage basis with respect to the entire steel microstructure, 40% or more and less than 85% of a lower bainite, 5% or more and less than 40% martensite including tempered martensite, 10% or more and 30% or less retained austenite, and 10% or less (including 0%) polygonal ferrite, the retained austenite having an average C content of 0.60% by mass or more.

Area Percentage of Lower Bainite: 40% or more and less than 85%

The formation of bainitic ferrite resulting from bainitic transformation is required to increase the C content of untransformed austenite and form retained austenite that provides the TRIP effect in a high-strain region during working to increase strain dispersibility. Transformation from austenite to bainite occurs in a wide temperature range of about 150° C. to about 550° C. Various types of bainite are formed in this temperature range. In the related art, such various types of bainite are often simply defined as bainite. To achieve target strength and workability in the present disclosure, however, bainite microstructures need to be clearly defined. Thus, upper bainite and lower bainite are defined below. The following explanation is given with reference to FIG. 1.

As illustrated in FIG. 1(A), the upper bainite refers to lath-like bainitic ferrite in which a carbide grown in the same direction is not present in the lath-like bainitic ferrite but present between laths. As illustrated in FIG. 1(B), the lower bainite refers to lath-like bainitic ferrite in which the carbide grown in the same direction is present in the lath-like bainitic ferrite.

The difference between the formation states of the carbide in the bainitic ferrite significantly affects the strength of the steel sheet. The upper bainite is softer than the lower bainite. To achieve a target tensile strength in the present disclosure, the lower bainite needs to have an area percentage of 40% or more. An area percentage of the lower bainite of 85% or more results in the failure of the formation of retained austenite sufficient for good workability. Thus, the area percentage of the lower bainite is less than 85%. The lower limit thereof is more preferably 50% or more. The upper limit is more preferably less than 80%.

Area Percentage of Martensite Including Tempered Martensite: 5% or more and less than 40%

Martensite is a hard phase and increases the strength of the steel sheet. The formation of martensite before bainitic transformation facilitates the bainitic transformation. If the area percentage of martensite (in the case of including as-quenched martensite, the total of tempered martensite and as-quenched martensite) is less than 5%, bainitic transformation is not sufficiently promoted, thus failing to achieve the area percentage of bainite described below. If the area percentage of martensite is 40% or more, the stable content of retained austenite cannot be ensured because of the decrease of a bainite microstructure, thus disadvantageously degrading workability such as ductility. Accordingly, the area percentage of martensite is 5% or more and less than 40%. The lower limit thereof is preferably 10% or more. The upper limit thereof is preferably 30% or less. Martensite needs to be clearly distinguished from the upper bainite. Martensite can be distinguished by microstructure observation. As-quenched martensite without being tempered has a microstructure containing no carbide. Tempered martensite has a microstructure in which a carbide having growth directions is present.

In the present disclosure, martensite needs to include tempered martensite from the viewpoint of improving stretch-flangeability.

Percentage of Tempered Martensite in Martensite: 80% or more

If the percentage of tempered martensite is less than 80% of the area percentage of all martensite, although the steel sheet has a tensile strength of 1,320 MPa or more, the steel sheet can fail to have sufficient ductility. The reason for this is as follows: As-quenched martensite having a high C content has a very high hardness, low deformability, and low toughness. In the case of a high as-quenched martensite content, the steel sheet breaks in a brittle manner when strain is applied thereto, failing to provide good ductility or stretch-flangeability. By tempering such as-quenched martensite, the strength is slightly decreased, whereas the deformability of martensite itself is markedly improved. Thus, the steel sheet has a no brittle fracture when strain is applied thereto. In the case where the microstructure having the composition of the present disclosure is provided, TS×T. EL is 15,000 MPa·% or more, and TS×λ is 50,000 MPa·% or more. Accordingly, the percentage of tempered martensite in martensite is preferably 80% or more of the area percentage of all martensite present in the steel sheet, more preferably 90% or more of the area percentage of all martensite. Tempered martensite is observed with, for example, a scanning electron microscope (SEM) and identified as a microstructure in which a fine carbide is precipitated in martensite. Tempered martensite can be clearly distinguished from as-quenched martensite, in which such a carbide is not observed in martensite.

Area Percentage of Retained Austenite: 10% or more and 30% or less

Retained austenite undergoes martensitic transformation by the TRIP effect during working. The resulting hard martensite having a high C content promotes an increase in strength and increases strain dispersibility to improve ductility.

In the steel sheet of the present disclosure, after the steel sheet partially undergoes martensitic transformation, in particular, retained austenite having an increased carbon content is formed using, for example, the lower-bainite transformation in which the formation of a carbide is inhibited. Thus, retained austenite that can provide the TRIP effect even in a high strain region during working can be provided.

The use of a combination of retained austenite, the lower bainite, and martensite provides the steel sheet having an outstanding balance between strength and workability and having satisfactory workability even in a high-strength region with a tensile strength (TS) of 1,320 MPa or more. Specifically, the value of TS×T. EL is 15,000 MPa·% or more, and the value of TS×λ is 50,000 MPa·% or more.

Here, retained austenite is distributed in a state of being surrounded by martensite and the lower bainite. Thus, a difficulty lies in accurately quantifying its content (area percentage) by microstructure observation. However, it has been found that when the retained austenite content determined from intensity measurement by X-ray diffraction (ERD), which is a common technique for measuring the retained austenite content, specifically, determined from the intensity ratio of ferrite to austenite obtained by X-ray diffraction, is 10% or more, a sufficient TRIP effect is provided, the tensile strength (TS) is 1,320 MPa or more, and TS×T. EL is 15,000 MPa·% or more. Note that it is confirmed that the retained austenite content determined by the common technique for measuring a retained austenite content is equivalent to the area percentage of retained austenite with respect to all microstructure of the steel sheet.

A retained austenite content of less than 10% does not result in a sufficient TRIP effect. A retained austenite content of more than 30% results in an excessive amount of hard martensite formed after the TRIP effect is provided, disadvantageously degrading toughness and stretch-flangeability. Accordingly, the retained austenite content is 10% or more and 30% or less. The lower limit thereof is preferably 14% or more. The upper limit thereof is preferably 25% or less. The lower limit is more preferably 18% or more. The upper limit is more preferably 22% or less.

Area Percentage of Polygonal Ferrite: 10% or less (including 0%)

An area percentage of polygonal ferrite of more than 10% makes it difficult to satisfy a tensile strength (TS) of 1,320 MPa or more. Furthermore, strain is concentrated on soft polygonal ferrite contained in a hard microstructure during working to readily forming cracks during working; thus, a desired workability is not provided. Here, at an area percentage of polygonal ferrite of 10% or less, a small amount of polygonal ferrite is separately dispersed in a hard phase even when polygonal ferrite is present, thereby suppressing the concentration of strain to prevent the degradation of workability. Accordingly, the area percentage of polygonal ferrite is 10% or less, preferably 5% or less, more preferably 3% or less, and may be 0%.

Average C Content of Retained Austenite: 0.60% or more by mass

To provide good workability by the use of the TRIP effect, the C content of retained austenite is important for a high-strength steel sheet with a tensile strength (TS) of about 1,320 MPa or more. The inventors have conducted studies and have found that in the steel sheet of the present disclosure, in the case where the average C content of retained austenite determined from the shift amount of a diffraction peak obtained by X-ray diffraction (XRD), which is a common technique for measuring the average C content of retained austenite (the average C content of retained austenite), is 0.60% or more by mass, better workability is provided. At an average C content of retained austenite of less than 0.60%, martensitic transformation can occur in a low-strain region during working to fail to provide the TRIP effect to improve workability in a high-strain region. Accordingly, the retained austenite has an average C content of 0.60% or more by mass, preferably 0.70% or more by mass. An average C content of retained austenite of more than 2.00% or more by mass results in excessively stable retained austenite; thus, martensitic transformation does not occur, i.e., the TRIP effect is not provided, during working, thereby possibly decreasing ductility. Accordingly, the retained austenite preferably has an average C content of 2.00% or less by mass. As the C content, a value measured by a method described in examples is used.

Mn Segregation Value at Surface (Difference Between Maximum and Minimum Values of Mn Concentration): 0.8% or less Mn segregates during the casting of the steel sheet and is extended in the rolling direction by hot rolling and cold rolling to form a Mn-rich portion and a Mn-poor portion in a streaky manner, in some cases. The Mn segregation also affects the microstructure as described above. A larger Mn segregation value at a steel-sheet surface (a difference between maximum and minimum values of a Mn concentration in the steel sheet) more easily results in the formation of segregates acting as starting points of cracks during the working of the steel sheet, adversely affecting workability, in particular, bending workability. The adjustment of the Mn segregation value requires the adjustment of the production conditions. In particular, the reduction ratio (rolling reduction) in the first pass in rough rolling is important. In the present disclosure, the Mn segregation tends to be reduced by setting the rolling reduction in the first pass in rough rolling to 10% or more. When annealing is performed, the Mn segregation can also be reduced by annealing the steel sheet in a single-phase austenite region for 200 seconds or more and 1,000 seconds or less, cooling the steel sheet from an annealing temperature to $Ac_3$—100° C. at an average cooling rate of 5° C./s or more, and cooling the steel sheet to a first temperature range of a martensitic transformation start temperature (Ms)—100° C. or higher and lower than Ms at an average cooling rate of 20° C./s or more. When the Mn segregation value is 0.8% or less, the degradation of workability can be inhibited. Thus, the Mn segregation value at the steel-sheet surface is 0.8% or less, preferably 0.6% or less, more preferably 0.5% or less. As the Mn segregation value, a value measured by a method described in examples is used.

The high-strength steel sheet having the foregoing characteristics according to the present disclosure has a tensile strength of 1,320 MPa or more, in which the ratio R/t of a limit bending radius (R) to a thickness (t) (hereinafter, referred to as a "limit bending index") is 2.0 or less, tensile strength×total elongation is 15,000 MPa·% or more, and tensile strength×hole expansion ratio is 50,000 MPa·% or more.

<Method for Producing High-Strength Steel Sheet>

A method for producing a high-strength steel sheet of the present disclosure will be described below. In the production method of the present disclosure, after a steel slab adjusted so as to have the foregoing component composition is produced, the slab is subjected to hot rolling and then cold rolling to form a cold-rolled steel sheet.

A steel slab having a size of 2,500 to 3,500 mm is heated in a temperature range of 1,230° C. or higher in terms of the surface temperature of the slab for 30 minutes or more. Hot rolling is performed by setting the rolling reduction in the first pass in rough rolling to 10% or more and is completed in a temperature range of 870° C. or higher and 950° C. or lower. The resulting hot-rolled steel sheet is coiled in a temperature range of 350° C. or higher and 720° C. or lower. If the rolling reduction in the first pass in the roughing pass is less than 10%, a Mn segregation value of more than 0.6% is easily obtained, degrading workability. Accordingly, the rolling reduction in the first pass in the roughing pass is 10% or more, preferably 15% or more.

A surface temperature of the slab of 1,230° C. or higher results in the promotion of dissolution of a sulfide, the reduction of Mn segregation, and reductions in the size and the number of inclusions. Thus, the surface temperature of the slab is 1,230° C. or higher. The heating rate during the heating the slab is 5 to 15° C./min. The soaking time of the slab is preferably 30 minutes or more.

The hot-rolled steel sheet is pickled and then cold-rolled at a reduction ratio of preferably, but not necessarily, 40% or more and 90% or less to form a cold-rolled steel sheet having a thickness of 0.5 mm or more and 5.0 mm or less.

Figure 2:
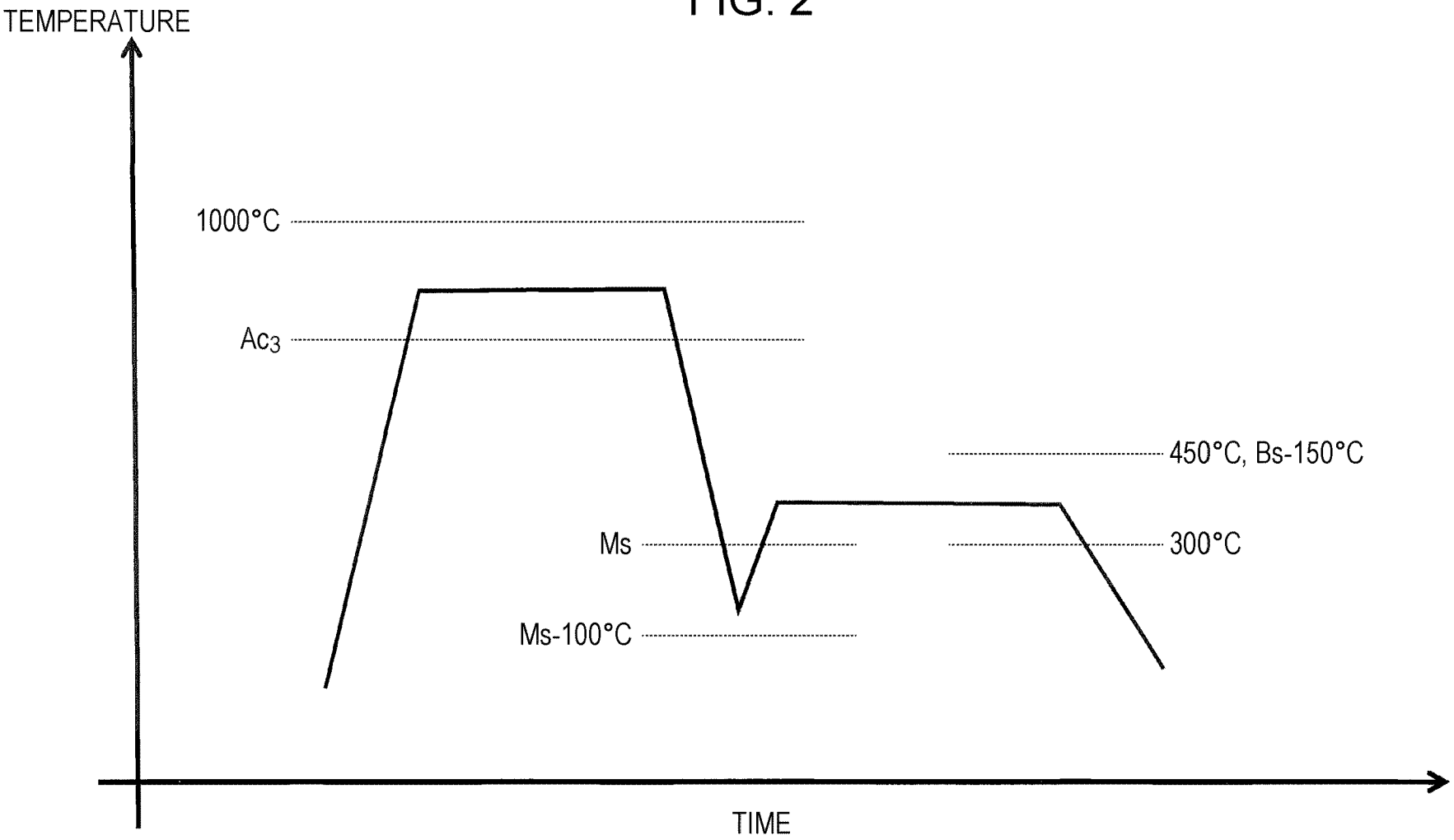
FIG. 2 is an explanatory drawing of heat treatment.

The resulting cold-rolled steel sheet is subjected to heat treatment illustrated in FIG. 2. The heat treatment will be described below with reference to FIG. 2.

Annealing is performed in the single-phase austenite region for 200 seconds or more and 1,000 seconds or less. The steel sheet of the present disclosure has, as a main phase, a low-temperature transformation phase, such as martensite, obtained by transformation from untransformed austenite. Polygonal ferrite is preferably minimized as much as possible. Thus, annealing in the single-phase austenite region is required. The annealing temperature is not particularly limited as long as the annealing is performed in the single-phase austenite region. An annealing temperature of higher than 1,000° C. results in significant growth of austenite grains to cause the coarsening of constituent phases (respective phases) formed by the subsequent cooling, thereby degrading toughness and so forth. Thus, the annealing temperature needs to be an $Ac_3$ point (austenite transformation point) ° C. or higher, preferably 850° C. or higher. The upper limit thereof is preferably 1,000° C. or lower.

Here, the $Ac_3$ point can be calculated from the following expression:

$$Ac_3 \text{ point } (^\circ \text{ C.}) = 910 - 203 \times [\text{C } \%]^{1/2} + 44.7 \times [\text{Si } \%] - 30 \times [\text{Mn } \%] + 700 \times [\text{P } \%] + 400 \times [\text{Al } \%] - 15.2 \times [\text{Ni } \%] - 11 \times [\text{Cr } \%] - 20 \times [\text{Cu } \%] + 31.5 \times [\text{Mo } \%] + 104 \times [\text{V } \%] + 400 \times [\text{Ti } \%]$$

where [X %] represents the content (% by mass) of a component element X in the steel sheet. When the element is not contained, [X %] is regarded as zero.

At an annealing time of less than 200 seconds, reverse transformation to austenite can fail to proceed sufficiently, and the reduction of the Mn segregation due to casting can fail to proceed sufficiently. An annealing time of more than 1,000 seconds leads to an increase in cost due to a large amount of energy consumption. Thus, the annealing time is 200 seconds or more and 1,000 seconds or less. The lower limit thereof is preferably 250 seconds or more. The upper limit thereof is preferably 500 seconds or less.

The cold-rolled steel sheet after the annealing is cooled from the annealing temperature to $Ac_3$—100° C. at an average cooling rate of 5° C./s or more and cooled from $Ac_3$—100° C. to the first temperature range of Ms—100° C. or higher and lower than the Ms point at an average cooling rate of 20° C./s or more. If the average cooling rate from the annealing temperature to $Ac_3$—100° C. is less than 5° C./s, polygonal ferrite can be excessively formed to fail to provide a strength of 1,320 MPa or more. Furthermore, Mn distribution can proceed to degrade bending workability. Thus, the average cooling rate from the annealing temperature to $Ac_3$—100° C. is 5° C./s or more, preferably 8° C./s or more.

After the annealing, by cooling the steel sheet to Ms—100° C. or higher and lower than the Ms point, part of austenite is subjected to martensitic transformation. If the lower limit of the first temperature range is lower than Ms—100° C., an excessive amount of untransformed austenite is transformed into martensite at this point, failing to achieve a good balance between strength and workability. If the lower limit of the first temperature range is Ms or higher, an appropriate amount of martensite cannot be ensured. Thus, the first temperature range is Ms—100° C. or higher to lower than the Ms point, preferably Ms—80° C. or higher and lower than the Ms point, more preferably Ms—50° C. or higher and lower than the Ms point. An average cooling rate of lower than 20° C./s results in the excessive formation and growth of polygonal ferrite and the precipitation of pearlite and so forth, failing to provide a desired microstructure of the steel sheet. Thus, the average cooling rate from $Ac_3$—100° C. to the first temperature range is 20° C./s or more, preferably 30° C./s or more, more preferably 40° C./s or more. The upper limit of the average cooling rate is not particularly limited as long as the cooling stop temperature does not vary. The foregoing Ms point can be determined by an approximate expression described below. Ms is an approximate value determined empirically.

$$Ms \ (^\circ \text{ C.}) = 565 - 31 \times [\text{Mn } \%] - 13 \times [\text{Si } \%] - 10 \times [\text{Cr } \%] - 18 \times [\text{Ni } \%] - 12 \times [\text{Mo } \%] - 600 \times (1 - \exp(-0.96 \times [\text{C } \%]))$$

where [X %] represents the content (% by mass) of a component element X in the steel sheet. When the element is not contained, [X %] is regarded as zero.

Regarding the steel sheet cooled to the first temperature range, the temperature of the steel sheet is increased to a second temperature range of 300° C. or higher, Bs—150° C. or lower, and 450° C. or lower, and then the steel sheet is retained in the second temperature range for 15 seconds or more and 1,000 seconds or less. Bs represents a bainitic transformation start temperature and can be determined by the following approximate expression. Bs is an approximate value determined empirically.

$$Bs \ (^\circ \text{ C.}) = 830 - 270 \times [\text{C } \%] - 90 \times [\text{Mn } \%] - 37 \times [\text{Ni } \%] - 70 \times [\text{Cr } \%] - 83 \times [\text{Mo } \%]$$

where [X %] represents the content (% by mass) of a component element X in the steel sheet. When the element is not contained, [X %] is regarded as zero.

In the second temperature range, the stabilization of austenite is allowed to proceed by tempering martensite formed by cooling from the annealing temperature to the first temperature range, transforming untransformed austenite into the lower bainite, concentrating the dissolved C into austenite, and so forth. If the upper limit of the second temperature range is higher than Bs—150° C. or 450° C., the upper bainite is formed without forming the lower bainite, and bainitic transformation itself is inhibited. If the lower limit of the second temperature range is lower than 300° C., the rate of diffusion of dissolved C is significantly decreased to decrease the C content of austenite, failing to obtain a necessary average C content of retained austenite. Thus, the second temperature range is 300° C. or higher, Bs—150° C. or lower, and 450° C. or lower, preferably 320° C. or higher, Bs—150° C. or lower, and 420° C. or lower.

If the residence time in the second temperature range is less than 15 seconds, the tempering of martensite and the lower-bainite transformation are insufficient to provide a desired microstructure of the steel sheet. This fails to sufficiently ensure the workability of the resulting steel sheet, in some cases. Thus, the residence time in the second temperature range needs to be 15 seconds or more. In the present disclosure, a residence time in the second temperature range of 1,000 seconds suffices because of the bainitic transformation promotion effect of martensite formed in the first temperature range. When large amounts of C and alloy components such as Cr and Mn are used like the present disclosure, bainitic transformation is usually slow; however, when both martensite and untransformed austenite are present like the present disclosure, the bainitic transformation is significantly fast. If the residence time in the second temperature range is more than 1, 000 seconds, a carbide is precipitated from untransformed austenite to be formed into retained austenite serving as a final microstructure of the steel sheet to fail to obtain stable retained austenite having a high C content, thereby possibly failing to one or both of desired strength and ductility. Thus, the residence time is 15 seconds or more and 1,000 seconds or less, preferably 100 seconds or more and 700 seconds or less.

In the heat treatment of the present disclosure, the residence temperature need not be constant as long as it is within the predetermined temperature range described above. The purport of the present disclosure is not impaired even if the residence temperature varies within the predetermined temperature range. The same is true for the cooling rate. Furthermore, a steel sheet may be subjected to the heat treatment with any apparatus as long as heat history is just satisfied. Moreover, after the heat treatment, subjecting surfaces of the steel sheet to temper rolling for shape correction is included in the scope of the present disclosure.

EXAMPLES

Exemplary examples of the present disclosure will be described below.

Cast slabs, each having a size of 3,000 mm, obtained by refining steels having component compositions given in Table 1 were heated in such a manner that the heating temperature of surface layers of the slabs was 1,250° C. Each of the cast slabs was subjected to rough rolling under conditions given in Table 2 and then finish hot rolling at 870° C. to form a hot-rolled steel sheet, followed by coiling at 550° C. The hot-rolled steel sheet was subjected to pickling and cold rolling at a reduction ratio (rolling reduction) of 60% to form a cold-rolled steel sheet having a thickness of 1.2 mm. The resulting cold-rolled steel sheet was subjected to heat treatment under conditions given in Table 2. Note that the cooling stop temperature Tl in Table 2 is defined as a temperature at which the cooling of the steel sheet is terminated when the steel sheet is cooled from $Ac_3$—100° C. The resulting steel sheet was subjected to temper rolling at a reduction ratio (elongation percentage) of 0.3%. The characteristics of the resulting steel sheet were evaluated by methods described below.

A sample was cut from each of the steel sheets and polished. The microstructure of a surface having the normal parallel to the direction of the sheet width was observed in 10 fields of view with a scanning electron microscope (SEM) at a magnification of ×3,000. The area percentage of each phase was measured to identify the phase structure of each crystal grain.

The retained austenite content was determined as follows: A steel sheet was ground and polished in the thickness direction so as to have a thickness of ¼ of the original thickness thereof. The retained austenite content was determined by X-ray diffraction intensity measurement. Co-Kα was used as an incident X-ray. The retained austenite content was calculated from ratios of diffraction intensities of the (200), (220), and (311) planes of austenite to the respective (200), (211), and (220) planes of ferrite.

The average C content of retained austenite was determined as follows: A lattice constant was determined from intensity peaks of the (200), (220), and (311) planes of austenite by the X-ray diffraction intensity measurement. The average C content (% by mass) was determined from a computational expression described below.

$$a0=0.3580+0.0033\times[C\ \%]+0.00095\times[Mn\ \%]+0.0056\times[Al\ \%]+0.022\times[N\ \%]$$

where a0 represents a lattice constant (nm), and [X %] represents percent by mass of element X. Note that percent by mass of an element other than C was defined as percent by mass with respect to the entire steel sheet.

Regarding the measurement of a Mn segregation value at a surface, a 1-mm-long portion of a steel-sheet surface perpendicular to the rolling direction was subjected to line analysis with an EPMA. The difference between maximum and minimum values obtained by the analysis was used as the Mn segregation value.

A tensile test was performed according to JIS Z2241 using a JIS No. 5 test piece (JIS Z 2201) whose longitudinal direction was the width direction of the steel sheet. The tensile strength (TS) and the total elongation (T. EL) were measured. The product of the tensile strength and the total elongation (TS×T. EL) was calculated to evaluate a balance between strength and workability (ductility). In the present disclosure, the case where TS×T. EL≥15,000 (MPa·%) was evaluated as good.

A test piece having a size of 100 mm×100 mm was sampled. A hole expansion test was performed three times according to JFST 1001 (The Japan Iron and Steel Federation Standard) to determine the average hole expansion ratio (%), and the stretch-flangeability was evaluated. The product of the tensile strength and the hole expansion ratio (TS×λ) was calculated to evaluate the balance between the strength and the workability (stretch-flangeability). In the present disclosure, the case where TS×λ≥50,000 (MPa·%) was evaluated as good.

Workability

A JIS No. 3 test piece whose longitudinal direction was the width direction of the coil was sampled from a position ½ of the width. The limit bending radius (R (mm)) was determined by a V-block bend method (the tip angle of a pressing hardware: 90°, tip radius R: changed from 0.5 mm in decrements of 0.5 mm) according to JIS Z2248. A value obtained by dividing the limit bending radius by the thickness (t (mm)), i.e., R/t, was used as an index. The case where R/t was 2.0 or less was evaluated as good.

Table 3 lists the evaluation results.

Table 3 clearly reveals that in each of the steel sheets of the present disclosure, the tensile strength is 1,320 MPa or more, the value of TS×T. EL is 15,000 MPa·% or more, and the value of TS×λ is 50,000 MPa·% or more, which indicates that each of the steel sheets of the present disclosure has both good strength and good workability.

TABLE 1

(% by mass)

| | C | Si | Mn | P | S | Al | N | Cr | V | Ni | Mo | Cu | Ti | Nb | B | Ca | REM | Ac3 (° C.) | Ms (° C.) | Bs (° C.) |
|---|---|---|---|---|---|---|---|---|---|---|---|---|---|---|---|---|---|---|---|---|
| A | 0.21 | 1.4 | 2.0 | 0.011 | 0.002 | 0.03 | 0.0035 | | | | | | | | 0.0012 | | | 839 | 375 | 593 |
| B | 0.24 | 1.5 | 1.2 | 0.013 | 0.001 | 0.03 | 0.0034 | | | | | | | 0.02 | | | | 863 | 385 | 657 |
| C | 0.33 | 1.5 | 2.2 | 0.014 | 0.002 | 0.04 | 0.0037 | | 0.20 | | | | | | | | | 841 | 314 | 543 |
| D | 0.30 | 2.0 | 2.0 | 0.010 | 0.002 | 0.05 | 0.0030 | | | | | | | | | | | 855 | 327 | 569 |
| E | 0.12 | 1.6 | 1.9 | 0.012 | 0.002 | 0.03 | 0.0035 | | | | | | | | | | | 875 | 420 | 627 |
| F | 0.24 | 1.0 | 0.2 | 0.011 | 0.001 | 0.04 | 0.0038 | | | | | | | | | | | 873 | 422 | 747 |
| G | 0.27 | 1.2 | 2.3 | 0.017 | 0.002 | 0.05 | 0.0031 | | | | | | | 0.01 | | | | 821 | 341 | 550 |
| H | 0.33 | 2.3 | 1.3 | 0.015 | 0.002 | 0.05 | 0.0033 | | | | | | | | | | | 888 | 332 | 624 |
| I | 0.35 | 1.6 | 1.5 | 0.008 | 0.002 | 0.03 | 0.0034 | | | | 0.01 | | | | | | | 834 | 326 | 600 |
| J | 0.38 | 1.8 | 2.1 | 0.014 | 0.001 | 0.04 | 0.0035 | | | | | | | | 0.0008 | | | 828 | 293 | 538 |
| K | 0.23 | 1.7 | 3.1 | 0.011 | 0.001 | 0.03 | 0.0037 | | | | | | | | | | | 815 | 328 | 489 |
| L | 0.37 | 2.2 | 1.3 | 0.015 | 0.001 | 0.04 | 0.0036 | | | | | 0.2 | | | | | | 868 | 317 | 613 |
| M | 0.33 | 1.7 | 1.5 | 0.014 | 0.001 | 0.04 | 0.0040 | | | | | | 0.03 | | 0.0010 | | | 862 | 333 | 606 |
| O | 0.37 | 1.8 | 2.2 | 0.013 | 0.001 | 0.03 | 0.0034 | 0.2 | | | | | | | | | | 820 | 292 | 518 |

TABLE 1-continued

| | C | Si | Mn | P | S | Al | N | Cr | V | Ni | Mo | Cu | Ti | Nb | B | Ca | REM | Ac3 (° C.) | (% by mass) Ms (° C.) | Bs (° C.) |
|---|---|---|---|---|---|---|---|---|---|---|---|---|---|---|---|---|---|---|---|---|
| P | 0.30 | 2.1 | 1.9 | 0.011 | 0.001 | 0.03 | 0.0036 | | | 0.2 | | | | | | | | 852 | 325 | 571 |
| Q | 0.32 | 1.6 | 1.6 | 0.012 | 0.001 | 0.04 | 0.0041 | | | | | | | | | 0.003 | 0.002 | 843 | 336 | 600 |

Values outside the range of the present invention are underlined.

TABLE 2

| Sample No. | Type of steel | Rolling reduction in first pass in rough rolling (%) | Annealing temperature (° C.) | Annealing time (s) | Average cooling rate to $Ac_3$ - 100° C. (° C./s) | Average cooling rate to cooling stop temperature T1 (° C./s) | Cooling stop temperature T1 (° C.) | Ms (° C.) | Holding temperature in second temperature range (° C.) | Holding time in second temperature range (s) | Remarks |
|---|---|---|---|---|---|---|---|---|---|---|---|
| 1 | A | 12 | 880 | 200 | 11 | 23 | 331 | 375 | 380 | 400 | Example |
| 2 | A | 12 | 880 | 300 | 11 | 31 | 353 | 375 | 380 | 600 | Example |
| 3 | A | 12 | 870 | 300 | 10 | 25 | 162 | 375 | 370 | 600 | Comparative example |
| 25 | A | 12 | 870 | 300 | 3 | 30 | 350 | 375 | 380 | 600 | Comparative example |
| 26 | A | 5 | 870 | 300 | 10 | 30 | 350 | 375 | 380 | 600 | Comparative example |
| 4 | B | 12 | 870 | 250 | 9 | 61 | 336 | 385 | 420 | 500 | Example |
| 5 | B | 12 | 780 | 400 | 6 | 23 | 283 | 385 | 400 | 500 | Comparative example |
| 6 | C | 12 | 880 | 150 | 10 | 22 | 274 | 311 | 330 | 600 | Comparative example |
| 7 | C | 12 | 850 | 300 | 10 | 61 | 265 | 311 | 380 | 300 | Example |
| 8 | D | 12 | 860 | 250 | 9 | 20 | 261 | 327 | 330 | 800 | Example |
| 9 | D | 12 | 870 | 350 | 10 | 22 | 342 | 327 | 320 | 500 | Comparative example |
| 10 | D | 12 | 870 | 300 | 10 | 21 | 273 | 327 | 280 | 600 | Comparative example |
| 11 | E | 12 | 880 | 200 | 10 | 25 | 365 | 420 | 380 | 600 | Comparative example |
| 12 | F | 12 | 880 | 300 | 9 | 45 | 394 | 422 | 400 | 500 | Comparative example |
| 13 | G | 12 | 860 | 400 | 12 | 28 | 243 | 329 | 320 | 500 | Example |
| 14 | H | 12 | 890 | 350 | 9 | 20 | 284 | 332 | 370 | 300 | Example |
| 15 | H | 12 | 870 | 300 | 8 | 11 | 292 | 332 | 390 | 400 | Comparative example |
| 16 | H | 12 | 880 | 400 | 8 | 21 | 293 | 332 | 460 | 500 | Comparative example |
| 17 | I | 12 | 870 | 250 | 10 | 23 | 255 | 326 | 310 | 600 | Example |
| 18 | J | 12 | 860 | 400 | 12 | 56 | 255 | 287 | 320 | 700 | Example |
| 19 | K | 12 | 840 | 350 | 11 | 25 | 246 | 281 | 350 | 600 | Comparative example |
| 20 | L | 12 | 870 | 250 | 10 | 20 | 243 | 317 | 380 | 600 | Example |
| 21 | M | 12 | 880 | 300 | 11 | 22 | 292 | 333 | 370 | 500 | Example |
| 22 | O | 12 | 870 | 400 | 13 | 43 | 250 | 292 | 310 | 600 | Example |
| 23 | P | 12 | 870 | 240 | 9 | 25 | 267 | 325 | 330 | 600 | Example |
| 24 | Q | 12 | 870 | 350 | 11 | 27 | 290 | 336 | 360 | 700 | Example |

Values outside the range of the present invention are underlined.

TABLE 3

| Sample No. | Type of steel | α (%) | UB (%) | LB (%) | FM (%) | TM (%) | γ (%) | (TM/(FM + TM)) × 100 | Average C content of retained γ (% by mass) | Mn segregation value (%) | TS (MPa) | T-El (%) | λ (%) | R/t | TS × T-El (MPa · %) | TS × λ (MPa · %) | Remarks |
|---|---|---|---|---|---|---|---|---|---|---|---|---|---|---|---|---|---|
| 1 | A | 0 | 0 | 64 | 2 | 23 | 11 | 92 | 0.68 | 0.51 | 1347 | 15 | 42 | 1.7 | 20205 | 56574 | Example |
| 2 | A | 0 | 0 | 77 | 0 | 10 | 13 | 100 | 0.83 | 0.45 | 1382 | 16 | 52 | 1.7 | 22112 | 71864 | Example |

TABLE 3-continued

| Sample No. | Type of steel | α (%) | UB (%) | LB (%) | FM (%) | TM (%) | γ (%) | (TM/(FM + TM)) × 100 | Average C content of retained γ (% by mass) | Mn segregation value (%) | TS (MPa) | T-El (%) | λ (%) | R/t | TS × T-El (MPa · %) | TS × λ (MPa · %) | Remarks |
|---|---|---|---|---|---|---|---|---|---|---|---|---|---|---|---|---|---|
| 3 | A | 0 | 0 | 0 | 6 | 89 | 5 | 94 | 0.85 | 0.48 | 1448 | 10 | 44 | 2.1 | 14480 | 63712 | Comparative example |
| 25 | A | 5 | 0 | 72 | 2 | 10 | 11 | 83 | 0.84 | 0.86 | 1351 | 14 | 48 | 2.1 | 18914 | 64848 | Comparative example |
| 26 | A | 5 | 0 | 70 | 3 | 10 | 12 | 77 | 0.84 | 0.87 | 1339 | 14 | 45 | 2.2 | 18746 | 60255 | Comparative example |
| 4 | B | 0 | 0 | 55 | 2 | 29 | 14 | 94 | 0.93 | 0.34 | 1454 | 16 | 43 | 1.3 | 23264 | 62522 | Example |
| 5 | B | 24 | 0 | 11 | 2 | 43 | 20 | 96 | 0.74 | 0.38 | 1176 | 20 | 24 | 1.3 | 23520 | 28224 | Comparative example |
| 6 | C | 0 | 0 | 63 | 3 | 17 | 17 | 85 | 0.89 | 0.85 | 1511 | 15 | 37 | 2.5 | 22665 | 55907 | Comparative example |
| 7 | C | 0 | 0 | 50 | 2 | 28 | 20 | 93 | 1.15 | 0.42 | 1555 | 18 | 39 | 1.7 | 27990 | 60645 | Example |
| 8 | D | 0 | 0 | 56 | 1 | 27 | 16 | 96 | 1.02 | 0.46 | 1508 | 15 | 43 | 1.7 | 22620 | 64844 | Example |
| 9 | D | 0 | 0 | 37 | 56 | 0 | 7 | 0 | 1.25 | 0.48 | 1672 | 10 | 12 | 2.5 | 16720 | 20064 | Comparative example |
| 10 | D | 0 | 0 | 19 | 42 | 28 | 11 | 40 | 0.52 | 0.41 | 1608 | 13 | 15 | 2.5 | 20904 | 24120 | Comparative example |
| 11 | E | 0 | 0 | 67 | 2 | 25 | 6 | 93 | 0.42 | 0.43 | 1140 | 11 | 49 | 1.7 | 12540 | 55860 | Comparative example |
| 12 | F | 11 | 0 | 64 | 1 | 19 | 5 | 95 | 0.88 | 0.12 | 1278 | 11 | 33 | 2.1 | 14058 | 42174 | Comparative example |
| 13 | G | 0 | 0 | 56 | 2 | 27 | 15 | 93 | 0.98 | 0.54 | 1415 | 15 | 41 | 1.7 | 21225 | 58015 | Example |
| 14 | H | 0 | 0 | 47 | 2 | 30 | 21 | 94 | 1.15 | 0.41 | 1606 | 18 | 35 | 1.7 | 28908 | 56210 | Example |
| 15 | H | 0 | 35 | 21 | 2 | 18 | 24 | 90 | 1.06 | 0.38 | 1257 | 22 | 42 | 1.3 | 27654 | 52794 | Comparative example |
| 16 | H | 0 | 40 | 12 | 3 | 18 | 27 | 86 | 0.91 | 0.35 | 1219 | 21 | 37 | 1.3 | 25599 | 45103 | Comparative example |
| 17 | I | 0 | 0 | 56 | 2 | 21 | 21 | 91 | 0.82 | 0.48 | 1650 | 19 | 35 | 1.7 | 31350 | 57750 | Example |
| 18 | J | 0 | 0 | 62 | 2 | 10 | 26 | 83 | 1.44 | 0.53 | 1750 | 21 | 31 | 1.7 | 36750 | 54250 | Example |
| 19 | K | 0 | 0 | 14 | 64 | 17 | 5 | 21 | 0.93 | 0.92 | 1633 | 8 | 12 | 2.9 | 13064 | 19596 | Comparative example |
| 20 | L | 0 | 0 | 56 | 2 | 21 | 21 | 91 | 1.41 | 0.41 | 1708 | 18 | 32 | 1.7 | 30744 | 54656 | Example |
| 21 | M | 0 | 0 | 59 | 1 | 18 | 22 | 95 | 0.81 | 0.43 | 1550 | 16 | 40 | 1.7 | 24800 | 62000 | Example |
| 22 | O | 0 | 0 | 61 | 3 | 11 | 25 | 86 | 1.41 | 0.51 | 1724 | 22 | 35 | 1.7 | 37928 | 60340 | Example |
| 23 | P | 0 | 0 | 52 | 1 | 28 | 19 | 96 | 1.05 | 0.43 | 1488 | 16 | 44 | 1.7 | 23808 | 65472 | Example |
| 24 | Q | 0 | 0 | 58 | 1 | 19 | 22 | 96 | 0.86 | 0.41 | 1524 | 17 | 39 | 1.7 | 25908 | 59436 | Example |

Values outside the range of the present invention are underlined.
α: polygonal ferrite
UB: upper bainite
LB: lower bainite
FM: as-quenched martensite
TM: tempered martensite
γ: retained austenite

The invention claimed is:

1. A high-strength steel sheet comprising:

a component composition including:

C: 0.15% to 0.40%, by mass %,
Si: 0.5% to 2.5%, by mass %,
Mn: 0.5% to 2.4%, by mass %,
P: 0.1% or lower, by mass %,
S: 0.01% or lower, by mass %,
Al: 0.01% to 0.5%, by mass %,
N: 0.010% or lower, by mass %, and
Fe and incidental impurities; and a steel microstructure containing, on an area-percentage basis with respect to the entire steel microstructure, 40% or more and less than 85% of a lower bainite, 5% or more and less than 40% martensite including tempered martensite, 10% or more and 30% or less retained austenite, and 10% or less (including 0%) polygonal ferrite, the retained austenite having an average C content of 0.60% by mass or more, wherein:

a Mn segregation value at a surface of the steel sheet is 0.8% or less, the Mn segregation value being defined as a difference between maximum and minimum values of a Mn concentration at the surface as measured by line analysis in a 1-mm-long portion of the surface perpendicular to a rolling direction using electron probe microanalysis (EPMA), a tensile strength of the steel sheet is 1,320 MPa or more, a ratio R/t of a limit bending radius (R) to a thickness (t) of the steel sheet is 2.0 or less, tensile strength×total elongation of the steel sheet is 15,000 MPa·% or more, and tensile strength×hole expansion ratio of the steel sheet is 50,000 MPa·% or more.

2. The high-strength steel sheet according to claim 1, wherein the component composition further comprises one or more selected from the following groups A to D:

Group A:

one or more selected from:

Cr: 0.005% to 1.0%, by mass %,
V: 0.005% to 1.0%, by mass %,
Ni: 0.005% to 1.0%, by mass %, Mo: 0.005% to 1.0%, by mass %, and
Cu: 0.01% to 2.0%, by mass %, Group B:
one or more selected from:
Ti: 0.005% to 0.1%, by mass %, and
Nb: 0.005% to 0.1%, by mass %, Group C:
B: 0.0003% to 0.0050%, by mass %, and Group D:
one or more selected from:
Ca: 0.001% to 0.005%, by mass %, and
REM: 0.001% to 0.005%, by mass %.

3. A method for producing the high-strength steel sheet according to claim 1, the method comprising:

subjecting a steel slab to hot rolling at a reduction ratio of a first pass in rough rolling of 10% or more and then cold rolling to form a cold-rolled steel sheet, annealing the cold-rolled steel sheet in a single-phase austenite region for 200 seconds or more and 1,000 seconds or less, cooling the steel sheet from an annealing temperature to $Ac_3$—100° C. at an average cooling rate of 5° C./s or more, and cooling the steel sheet from $Ac_3$—100° C. to a first temperature range of a martensitic transformation start temperature (Ms)—100° C. or higher and lower than Ms at an average cooling rate of 20° C./s or more, after the cooling, increasing the temperature of the steel sheet to a second temperature range of 300° C. or higher, a bainitic transformation start temperature (Bs)—150° C. or lower, and 450° C. or lower, and after the temperature increase, retaining the steel sheet in the second temperature range for 15 seconds or more and 1,000 seconds or less.

4. A method for producing the high-strength steel sheet according to claim 2, the method comprising:

subjecting a steel slab to hot rolling at a reduction ratio of a first pass in rough rolling of 10% or more and then cold rolling to form a cold-rolled steel sheet, annealing the cold-rolled steel sheet in a single-phase austenite region for 200 seconds or more and 1,000 seconds or less, cooling the steel sheet from an annealing temperature to $Ac_3$—100° C. at an average cooling rate of 5° C./s or more, and cooling the steel sheet from $Ac_3$—100° C. to a first temperature range of a martensitic transformation start temperature (Ms)—100° C. or higher and lower than Ms at an average cooling rate of 20° C./s or more, after the cooling, increasing the temperature of the steel sheet to a second temperature range of 300° C. or higher, a bainitic transformation start temperature (Bs)—150° C. or lower, and 450° C. or lower, and after the temperature increase, retaining the steel sheet in the second temperature range for 15 seconds or more and 1,000 seconds or less.

5. The high-strength steel sheet according to claim 1, wherein the Mn segregation value is in the range of from 0.34% to 0.8%.

6. The high-strength steel sheet according to claim 2, wherein the Mn segregation value is in the range of from 0.34% to 0.8%.

7. The method according to claim 3, wherein the Mn segregation value is in the range of from 0.34% to 0.8%.

8. The method according to claim 4, wherein the Mn segregation value is in the range of from 0.34% to 0.8%.

* * * * *